United States Patent [19]

McClellan et al.

[11] Patent Number: 4,484,164

[45] Date of Patent: Nov. 20, 1984

[54] BRAIDLESS MOVABLE CONTACT WITH WIPING ACTION

[75] Inventors: David P. McClellan, Westminster; Frank W. Kussy, Randallstown, both of Md.

[73] Assignee: Siemens-Allis, Inc., Atlanta, Ga.

[21] Appl. No.: 479,365

[22] Filed: Mar. 28, 1983

[51] Int. Cl.[3] ..... H01H 73/00

[52] U.S. Cl. ..... 335/16; 335/192; 335/195; 200/244; 200/48 KB

[58] Field of Search ..... 335/16, 195; 200/DIG. 42, 48 KB, 153 G, 162, 244, 255, 250

[56] References Cited

U.S. PATENT DOCUMENTS

| | | | |
|---|---|---|---|
| 2,882,508 | 4/1959 | Watts | 339/18 B |
| 3,033,964 | 5/1962 | Titus | 200/250 |
| 3,560,683 | 2/1971 | Maier et al. | 335/195 |
| 4,013,984 | 3/1977 | Wafer | 335/16 |
| 4,031,492 | 6/1977 | Wafer | 335/16 |
| 4,077,025 | 2/1978 | Slade et al. | 335/16 |
| 4,132,968 | 1/1979 | Lang . | |
| 4,151,495 | 4/1979 | Rys et al. | 335/26 |
| 4,158,119 | 6/1979 | Kralik | 200/240 |
| 4,242,577 | 12/1980 | Maier et al. | 200/244 |
| 4,245,203 | 1/1981 | Wafer et al. | 335/16 |
| 4,263,487 | 4/1981 | Welter et al. | 200/48 KB |

FOREIGN PATENT DOCUMENTS

| | | | |
|---|---|---|---|
| 2043350 | 10/1980 | United Kingdom | 200/48 KB |

*Primary Examiner*—E. A. Goldberg
*Assistant Examiner*—George Andrews
*Attorney, Agent, or Firm*—F. W. Powers; J. L. James

[57] ABSTRACT

A so-called blow-off type current limiting circuit breaker is provided with an elongated movable contact arm that is pivotally mounted at one end thereof on a pin that projects from opposite sides of a support. The contact arm is constructed of parallel sections that are biased toward one another, by spring means disposed remote from the support, with the support being resiliently clamped between the sections to provide a good electrical connection between the support and contact arm. The pivot pin extends through aligned enlarged pivot apertures in the parallel sections to facilitate weld breaking. A wall of each pivot aperture is disposed to cooperate with the pivot pin to achieve a camming action that moves the contact arm slightly lengthwise after initial butting engagement of the circuit breaker main contacts to wipe the engaged contacts with respect to one another.

18 Claims, 13 Drawing Figures

BRAIDLESS MOVABLE CONTACT WITH WIPING ACTION

This invention relates to blow-off type current limiting circuit breakers in general and more particularly relates to a braidless movable contact with wiping action.

For circuit breakers connected in circuits that are capable of delivering relatively high currents, say 50,000 amps at 480 volts, conventional spring powered trip-free contact operating mechanisms do not respond quickly enough to prevent permanent damage to the circuit breaker when it is subjected to severe fault current conditions. Because of this, the prior art has provided circuit breaker constructions in which electrodynamic blow-off forces developed as a result of severe fault currents will act to separate the circuit breaker contacts even before typical overload current sensing devices release the contact operating mechanism for opening the circuit breaker. In effect, fast separation of the circuit breaker contacts as a result of electrodynamic forces serves to limit the magnitude of the fault current to a value that will not cause permanent damage to the circuit breaker. Examples of this type of current limiting circuit breaker are found in the B. DiMarco and A. J. Kralik copending U.S. patent application Ser. No. 256,305, filed 23 Apr. 1981, entitled "Electromagnetically Actuated Anti-Rebound Latch", now U.S. Pat. No. 4,409,573 and in U.S. Pat. No. 3,593,227, issued 13 July 1967 to G. F. Mitskevich et al for "Automatic Electrodynamic Blowoff Breaker With Stationary Contact Form Of Two Series Wound U-Shaped Member".

For current limiting circuit breakers as well as other circuit breakers that are required to have relatively high continuous current ratings, say 600 amps at 240 volts, when the movable contact means included a pivoted contact arm for making and breaking the circuit at a single location, the arm was usually connected in circuit by a so-called flexible braid. Such braids have proven troublesome because under very high current conditions the individual strands forming the braid tend to move unpredictably, sometimes opposing circuit opening. In addition, the braid has mass that tends to slow contact separation.

The prior art has attempted to solve the foregoing problems by bonding the strands of the braid together and by shaping the circuit breaker housing to provide a chamber or pocket for the braid.

However, a more desirable solution is to eliminate the braid. This has often been done by utilizing a movable bridging contact, but this complicates the operating mechanism and/or requires additional space. U.S. Pat. No. 4,245,203, issued 13 Jan. 1981 to J. A. Wafer and M. B. Yamat for a "Circuit Interrupter With Pivoting Contact Arm Having A Clinch-Type Contact" eliminates the braid by placing the pivot end of the contact arm between the arms of a short yoke and in wiping contact therewith. However, the device of said Pat. No. 4,245,203 fails to provide appropriate means to provide pressure at the joint to achieve satisfactory high current operation, nor is the structure capable of achieving wiping engagement of the butting main contacts during engagement thereof.

The instant invention solves the above problems of the prior art by constructing the contact arm of generally closely spaced parallel elongated sections that are biased against and are in wiping engagement with opposite sides of a stationary circuit element. A pivot pin on the stationary circuit element extends through aligned enlarged apertures in the parallel sections to facilitate weld breaking. Each aperture is partially defined by a surface that is positioned to cooperate with the pivot pin in such a manner that the butting main contacts engage with a wiping action. Under severe fault current conditions currents flowing in the sections of the contact arm generate an attractive force that tends to increase clamping forces at the contact pivot in opposition to the blowoff forces at the interfaces between the contact arm sections and the stationary circuit element. The contact arm may be constructed to balance these blowoff and attractive forces or to achieve a predetermined relationship therebetween.

Accordingly, the primary object of the instant invention is to provide a circuit breaker that includes a novel improved braidless connection between a contact arm and the element on which it is pivoted.

Another object is to provide a braidless connection of this type having provisions for achieving wiping of butting main contacts.

Still another object is to provide a braidless connection of this type wherein pressures at the pivot joint may be controlled.

These objects, as well as other objects of this invention shall become readily apparent after reading the following description of the accompanying drawings, in which.

Figure 9A:
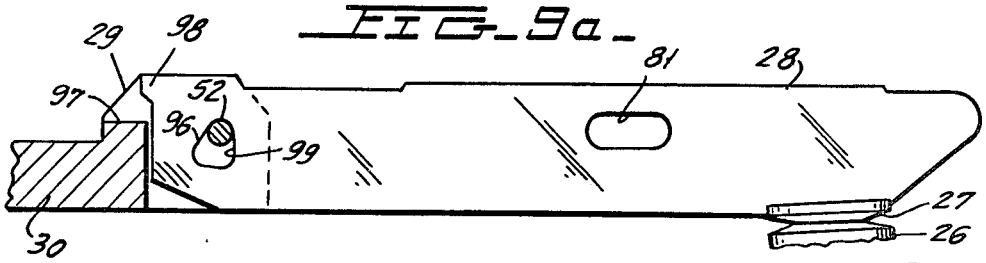

FIGS. 9*a* through 9*e* are side elevations of the movable contact arm in different positions thereof. In FIG. 9*a* the contact arm is fully closed, in FIGS. 9*b* and 9*c* the contact arm is shown moving progressively toward the full open position of FIG. 9*d*, and in FIG. 9*e* the contact arm is shown in its position of initial engagement between the movable and stationary contacts.

Now referring to the Figures. Circuit breaker 10 is a three-pole unit disposed within a molded insulated housing consisting of shallow base 11 and removable front cover 12 which mate along line 14. Partitions 16, 17 in base 11 extend parallel to sides 18, 19 thereof to divide base 11 into three side-by-side, longitudinally extending compartments each of which contains the current carrying elements of an individual pole. In a manner well known to the art, the center compartment formed between partitions 16, 17 also houses a common trip-free, overcenter toggle type contact operating mechanism 15 which, as will hereinafter be seen, acting through transverse insulating tie bar 21 simultaneously opens and closes all poles of circuit breaker 10 during manual operation and simultaneously opens circuit breaker 10 upon the occurrence of predetermined moderate overloads and moderate short circuits.

Figure 1:
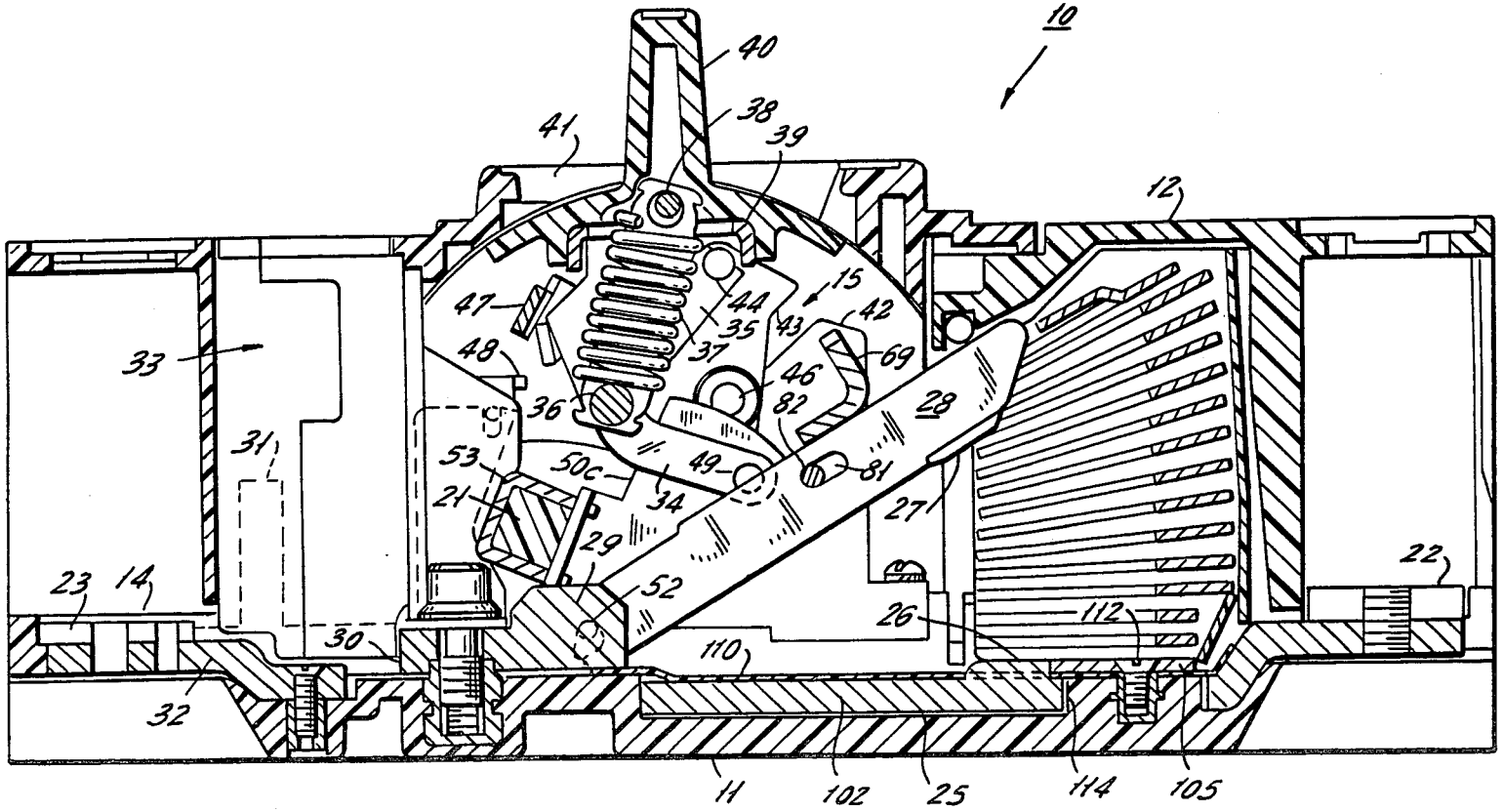
FIG. 1 is a longitudinal cross-section of a molded case circuit breaker that embodies the teachings of the instant invention.
Figure 2:
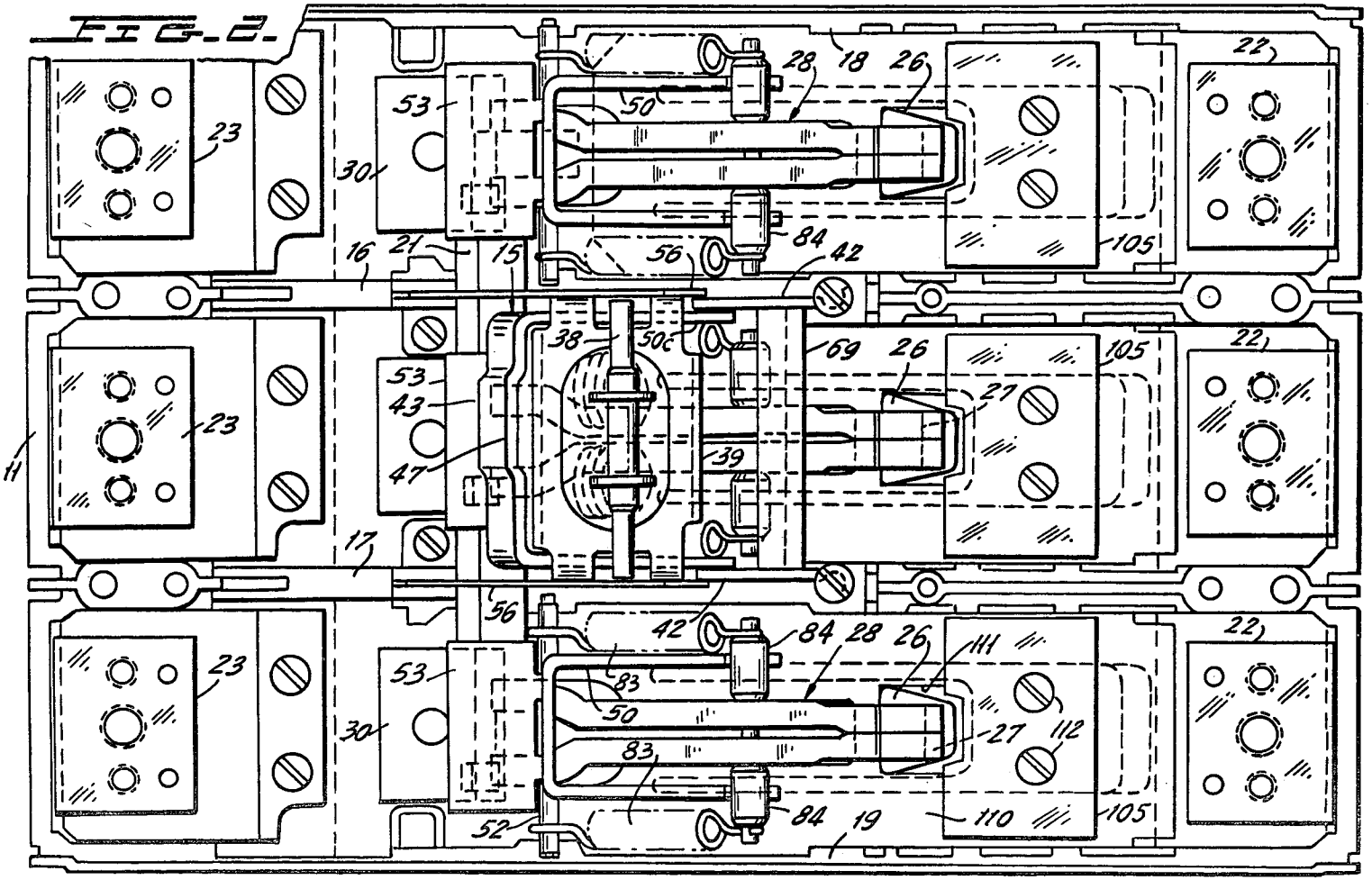
FIG. 2 is a plan view of the circuit breaker of FIG. 1 with the arc chutes, automatic overload trip unit, housing cover and manual operating handle removed to better reveal other elements of the circuit breaker.

Since the current carrying elements of all three poles are essentially identical, the current carrying elements of only one pole shall be described herein with particular reference to FIG. 1. That is, the current path between line terminal 22 and load terminal 23 located at opposite ends of housing 11, 12 comprises terminal strap 25 (FIG. 3), stationary contact 26, movable contact 27, movable contact arm 28, conducting support 29, terminal strap 30 formed integrally with support 29, conducting element 31 (typically a bimetal heater extending through overload current sensing automatic trip unit 33), and strap 32 having load terminal 23 mounted thereon.

Figures 6, 7, 8:
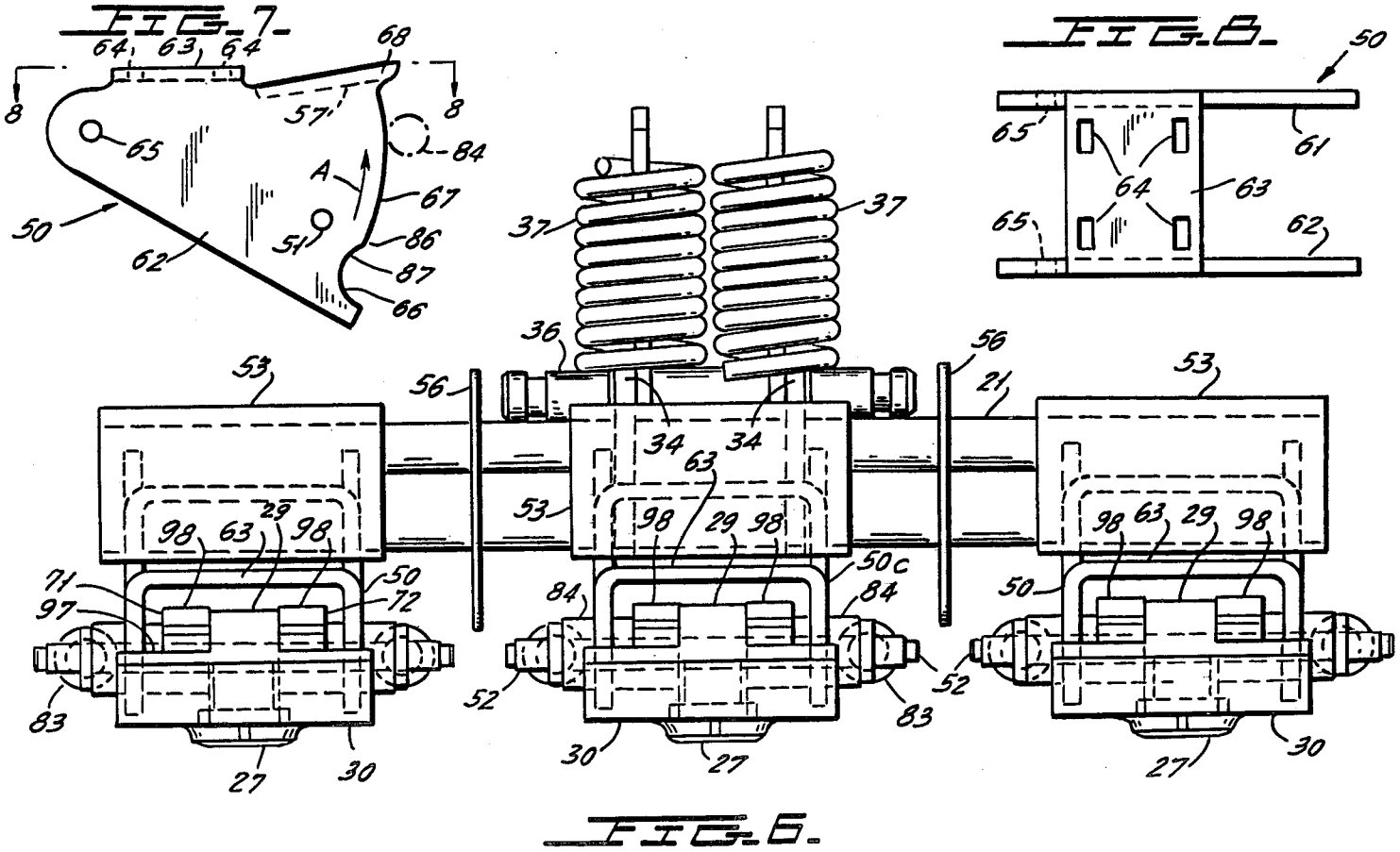
FIG. 6 is an elevation of the elements in FIG. 4, looking in the direction of arrows 6—6.
FIG. 7 is a side elevation of the drive means element for the movable contact arm.
FIG. 8 is an end view of the drive means element, looking in the direction of arrows 8—8 of FIG. 7.

The toggle portion of contact operating mechanism 15 includes lower link 34 and upper link 35 pivotally connected at knee 36. Coiled tension springs 37 are connected between knee 36 and transverse pin 38, the latter being supported by and movable with operating member 39 having insulating handle extension 40 projecting forward of cover 12 through opening 41 therein. A fixed pivot (not shown) on mechanism frame 42 pivotally supports operating member 39. The end of upper toggle link 35 remote from knee 36 is mounted to latchable cradle 43 at pivot 44. Cradle 43 is mounted on frame 42 at pivot 46 and is pivotable about the latter in a counterclockwise direction as viewed in FIG. 1 to bring cradle latching formation 47 into engagement with releasable latch 48 that projects from trip unit 33. The end of lower toggle link 34 remote from knee 36 is connected by pivot 49 to drive means **50*c* at aperture 51 thereof (FIG. 7). At a point remote from pivot 49 drive means 50*c* is pivotally mounted on pin 52 that also provides a pivotal connection between movable contact arm 28 and support 29. When toggle 34, 35 is extended as in FIG. 4, drive means 50*c* is in its Closed position and when toggle 34, 35 is collapsed as in FIG. 1, drive means 50*c* is pivoted counterclockwise about pivot 52 to its Open position of FIG. 1**.

U-shaped clamp 53 connects drive means **50*c* to tie rod 21 at the center thereof. Each of the outer poles is provided with a drive means 50. The difference between drive means 50*c* and 50 is that the former does not have the shaded portion bounded by dash line 57 in FIG. 7 and aligned apertures 51 of the latter are not utilized. In each of the outer poles, drive means 50 is secured to tie rod 21 outboard of drive means 50*c*. In a manner well known to the art, transverse bar 21 extends through cut-aways in housing partitions 16, 17 that provide large enough apertures for free movement of bar 21 as drive means 50*c* and 50 pivot between their Open and Closed positions. These partition openings are otherwise covered by insulating sheets 56 mounted on bar 21 and movably positioned adjacent partitions 16, 17**.

For the most part, drive means **50*c* and 50 are identical so that only the latter will be described in detail. That is, drive means 50 is a generally U-shaped member having parallel arms 61, 62 connected by web 63 having apertures 64 which receive gripping ears (not shown) extending from clamp 53. Each of the arms 61, 62 is identical so that only arm 62 will be described in detail. Arm 62 includes aperture 65 through which contact arm pivot pin 52 extends. The edge of arm 62 remote from aperture 65 is provided with cam depression 66 and relatively long cam formation 67 adjacent to depression 66. At the end of formation 67 the edge having cam formation 66, 67 is provided with protrusion 68 which, in a manner to be hereinafter explained, limits opening motion of each outer pole contact arm 28 during blow-off. Opening movement of contact arm 28 in the center pole is limited by engagement of that arm 28 with transverse element 69 (FIG. 1) of mechanism frame 42**.

Figures 3, 4, 5:
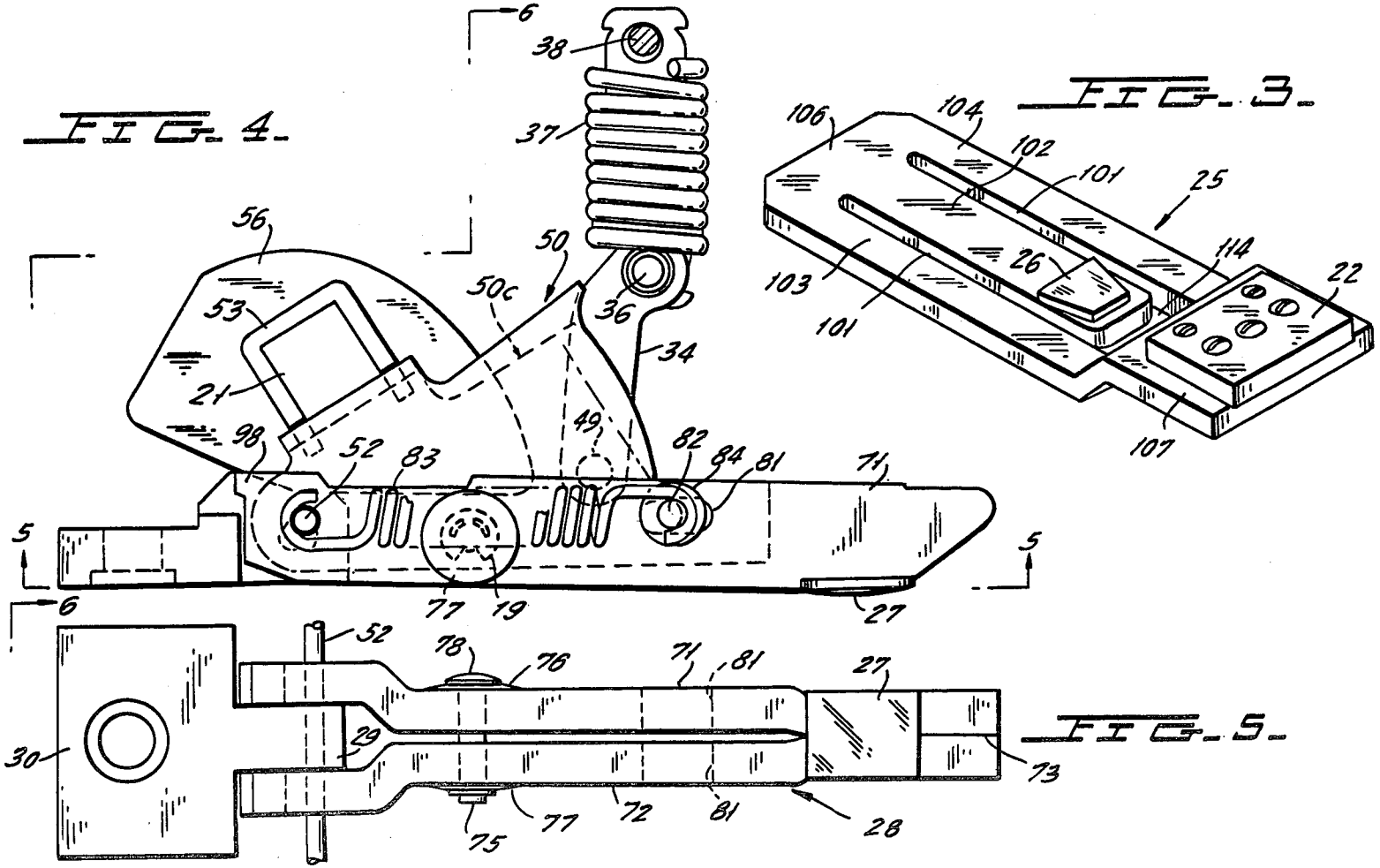
FIG. 3 is a perspective of the conducting strap on which the stationary contact is mounted.
FIG. 4 is a side elevation of the movable contact arm and selected elements in operative engagement therewith.
FIG. 5 is a bottom view of the movable contact arm and its support, looking in the direction of arrows 5—5 of FIG. 4.

As seen best in FIG. 5, movable contact arm 28 includes elongated parallel conducting sections 71, 72 that are closely spaced at the major central portions thereof. At the end of arm 28 having movable contact 27, sections 71, 72 are offset inwardly to abut one another and are firmly secured together as by brazing. At the end of arm 28 remote from contact 27, sections 71, 72 are offset outwardly and receive support 29 therebetween. Sections 71, 72 are biased toward one another by spring washers 76, 77 which lie against opposite sides of arm 28 and are mounted on pin 75 that extends through aligned apertures in sections 71, 72. Head 78 of pin 75 retains spring washer 76 and snap-on clip 79 is received in an annular depression near the end of pin 75 remote from head 78 to retain spring washer 77. The biasing force provided by spring 76, 77 acts to assure firm contact between sections 71, 72 and support 29 regardless of the angular position of contact arm 28.

Currents flowing in sections 71 and 72 of movable contact arm 28 are in the same direction, thereby generating an attracting force which aids the biasing forces generated by spring washers 76, 77. This electrodynamic attracting force is especially stronger in the extensive closely spaced central region between sections 71 and 72. As current flow increases, this electrodynamic force increases and serves to offset the blowoff forces at the interfaces between support 29 and sections 71, 72, with these blowoff forces increasing as current flow increases.

Sections 71, 72 are also provided with aligned longitudinally extending elongated slots 81 through which transverse pin 82 extends. Along the outboard side of each section 71, 72 is a coiled tension spring 83 secured to pivot pin 52 and transverse pin 82. Disposed between spring 83 and each of the sections 71, 72 is a cylindrical cam follower roller 84. Springs 83 bias cam followers 84 toward contact arm pivot 52 and against the surfaces of drive means 50 having cam formations 66, 67.

Under normal operating conditions, followers 84 are in depressions 66 so that as drive means 50 is operated between its Open and Closed positions, contact 26, 27 will be disengaged and engaged, respectively. However, with contacts 26, 27 engaged, if severe overload current conditions occur, electrodynamic forces acting to separate contacts 26, 27 will move contact arm 28 to its Open position of FIG. 1 before drive means 50 has an opportunity to move from its Closed position toward its Open position. When this occurs, initial movement of contact arm 27 in the circuit opening direction moves followers 84 in the upward direction with respect to FIG. 4 until they leave the cam depressions 66 and arrive at convex cam formations 67. The boundary 86 (FIG. 7) between cam formations 66, 67 is the overcenter position for contact arm 28. That is, when cam follower 84 moving in the contact opening direction indicated by arrow A in FIG. 7 leaves cam depression 66 and moves past point 86, the action of spring 83 biases follower 84 in the direction of arrow A. The curvature of cam formation 67 may be chosen so that the initial movement of follower 84 after it leaves cam depression 66, movement will be rapid. Such movement will slow somewhat as follower 84 approaches protrusion 68 so that by the time follower 84 engages protrusion 68, even though it is being biased in the opening position indicated by arrow A, there is no danger that they will move beyond protrusion 68. In addition, the deceleration of follower 84 is such that there is no danger of contact arm 28 rebounding toward closed circuit position after being driven to open circuit position by electrodynamic forces which accompany severe overload currents. Subsequent movement of drive means 50 to its Open position wil cause relative movement between drive means 50 and contact arm 28 to bring follower 84 into cam depression 66.

For the most part, cam follower 84 is normally seated in the deepest portion of cam pocket 66. This condition exists during closing movement of contact arm 28, up to the point where there is initial engagement of movable contact 27 with stationary contact 26. However, drive means 50 continues to move in the closing direction (clockwise with respect to FIG. 1) and by so doing, follower 84 is engaged by section 87 of cam depression 66. This forces transverse pin to move slightly away from pivot 52 thereby additionally tensioning springs 83. Even though the line of action of springs 83 is generally longitudinal with respect to contact arm 28, the angular relationship between cam surface portion 87 and follower 84 results in a relatively strong component of force in the contact closing direction.

The shape of cam section 67 is tailored so that during electrodynamic blowoff, as soon as follower 84 moves beyond 86, contact arm 28 is effectively in an overcenter position in the circuit opening direction. It is seen that this latter condition is achieved after relatively little movement of contact arm 28 in the opening direction.

Electrodynamic blowoff forces which open circuit breaker 10 during severe fault current conditions result from interactions of the magnetic fields that accompany currents flowing in contact arm 28 and stationary contact strap 25. The latter is stamped from conducting sheet material with the stamping process providing a generally U-shaped cutout that effectively forms three closely spaced elongated arms 102, 103, 104 that are joined by connecting section 106 at the end of strap 25 remote from line terminal 22. Terminal section 107 of strap 25 acts as a jumper between the ends of exterior arms 103, 104 remote from connecting section 106. The cross-sectional areas of exterior arms 103, 104 are essentially equal and the cross-sectional area of interior arm 102 is essentially equal to the combined cross-sectional areas of arms 103 and 104.

With circuit breaker 10 closed, movable contact arm 28, which confronts interior arm 102, is very closely spaced therefrom. The width of contact arm 28 is less than the width of interior arm 102 and the spaces between interior arm 102 and exterior arms 103, 104 are each less than the thickness of the stock from which strap 25 is stamped. Relatively stiff, flexible insulating sheet 110 is interposed between movable contact arm 28 and strap 25, covering most of the latter. Insulator 110 is provided with cutout 111 through which stationary contact 26 extends. Formations within base 11 operatively position strap 25. Arcing contact 105 acts as a clamp to retain strap 25. That is, arc runner 105 is provided with individual clearance apertures for two screws 112 that are received by threaded inserts (not shown) in base 11 after passing through the web portion 114 of U-shaped cutout 101 in strap 25, and clearance apertures in insulator 110 and arc runner 105.

Current entering strap 25 at terminal section 107 flows in the same direction through exterior arms 103, 104, through connecting section 106 and then combine and flow in the opposite direction through interior arm 102. At this time, current flow in movable contact arm 28 is in a direction opposite to the direction of current flow through interior arm 102 so that under severe fault current conditions, a very strong electrodynamic force is generated to repel movable contact arm 28, thereby moving the latter in circuit opening direction. While currents flowing in contact arm 28 and exterior arms 103, 104 are in the same direction, the attractive forces are not significant compared to the repelling forces generated between interior arm 102 and contact arm 28 because of the greater space from arm 28 to arms 103, 104 as compared to the distance between arms 28 and 102. Arm 28 is offset from arms 103 and 104 so that only the attracting components of force in the plane of motion for contact arm 28 will oppose the repelling force. The attracting forces acting normal to the plane of motion for contact arm 28 are in equal and opposite directions, thereby producing no net effect.

Figure 9B:
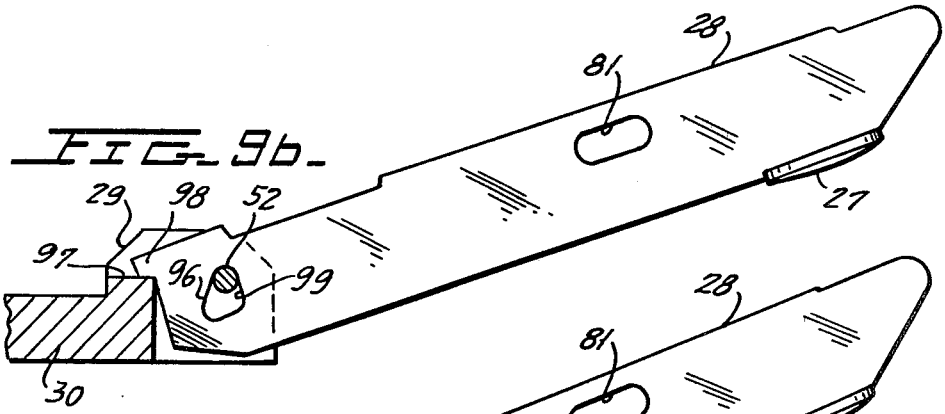
Figure 9C:
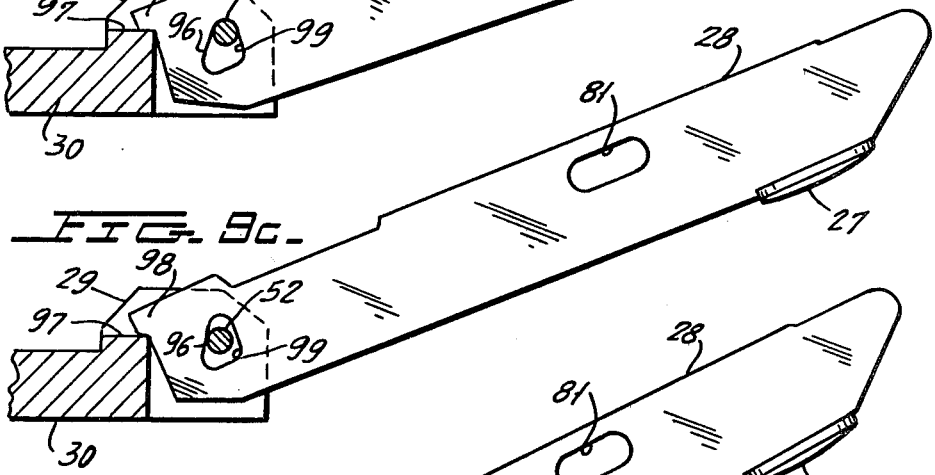
Figure 9D:
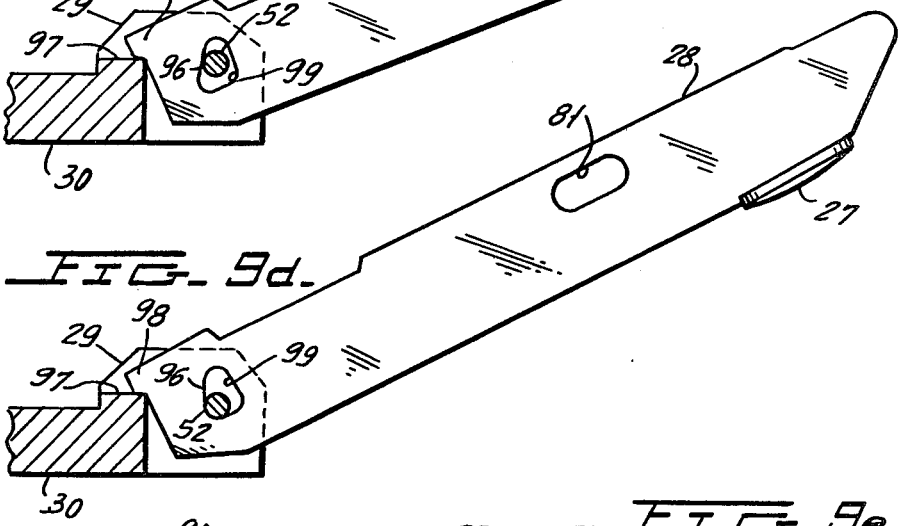
Figure 9E:
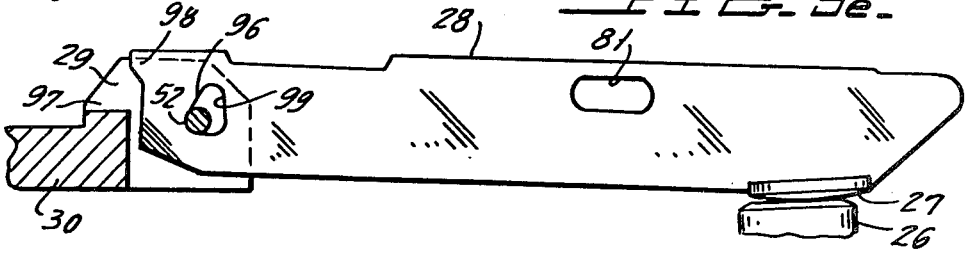

Now referring particularly to FIGS. 9*a* through 9*e*. The axis of contact arm pivot pin 52 is fixed in support 29 and extends through aligned enlarged apertures 99 in contact arm sections 71, 72. In FIG. 9*a*, contacts 26, 27 are shown in their finalengaged relationship. Initial opening movement for contact arm 28 takes place about pivot 52 as it is positioned at the upper portion of aperture 99 (FIG. 9*b*). At the outwardly offset portions of contact arm sections 71, 72, each is provided with an ear 98 that is engageable with the upper surface 97 of terminal strap 30. When this engagement occurs, the pivot point for contact arm 28 shifts to ears 98, 98 and the location of pivot 52 within apertures 99 changes (FIG. 9*c*), until in the fully open position of FIG. 9*d*, pin 52 is at the bottom of aperture 99 and adjacent to wall 96 thereof. Pivot 52 remains in this position relative to aperture 99 during the closing motion of contact arm 28 until there is initial engagement between movable contact 27 and stationary contact 26 (FIG. 9*e*). However, there is a continuing downward force being exerted by toggle 34, 35 on drive means 50 which in turn continues to exert a downward force on contact arm 28, causing the latter to pivot slightly about the engaging point between contacts 26 and 27. This causes the opposite end of contact arm 28 to move downward, and in so doing forces aperture wall 96 to ride against pin 52, thereby forcing contact arm 28 to the left with respect to FIG. 9*e* to the final closed position of FIG. 9*a*, thereby causing movable contact 27 to wipe across the upper surface of stationary contact 26.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A circuit breaker including a stationary contact, a single movable contact operable into and out of engagement with said stationary contact, an elongated contact arm having said movable contact at one end thereof, a pivot to which the other end of said contact arm is mounted for pivotal movement of said single contact arm between circuit breaker on and off positions, a conducting support for said pivot, said contact arm at said other end being bifurcated into first and second portions between which said support is disposed, and biasing means clamping said support between said portions to form good electrical wiping contact between said support and said contact arm while the latter is stationary as well as while it moves between said on and off positions.

2. A circuit breaker as set forth in claim 1 in which said contact arm also includes first and second sections closely spaced elongated sections extending from the respective first and second portions to the vicinity of said movable contact.

3. A circuit breaker as set forth in claim 2 in which the biasing means is remote from said pivot.

4. A circuit breaker as set forth in claim 1 in which the biasing means is disposed at a midregion lengthwise of said sections.

5. A circuit breaker as set forth in claim 1 in which the pivot extends through enlarged aligned openings in said first and second portions; a terminal strap on which the support is mounted; each of said portions including an ear that engages said terminal strap during movement of said contact arm to said off position to cooperate therewith and provide another center about which said contact arm pivots after initial pivotal movement thereof about said pivot as a center.

6. A circuit breaker as set forth in claim 5 in which each of the aligned openings is partly defined by a cam surface; during movement of said contact arm from said off position to initial engagement between said contacts said pivot being disposed at a first location along said cam surface, and further movement of said contact arm toward said arm position after initial engagement between said contacts causing each of said cam surfaces to move relative to said pivot to cooperate therewith and impart limited longitudinal movement to said contact arm whereby said movable contact wipes across said stationary contact.

7. A circuit breaker as set forth in claim 6 in which the limited longitudinal movement of said contact arm is toward said terminal strap.

8. A circuit breaker as set forth in claim 1 in which the pivot extends through enlarged openings in said first and second portions and each of said openings is partly defined by a cam surface; during movement of said contact arm from said off position to initial engagement between said contacts said pivot being disposed at a first location along said cam surface, and further movement of said contact arm toward said arm position after initial engagement between said contacts causing each of said cam surfaces to move relative to said pivot to cooperate therewith and impart limited longitudinal movement to said contact arm whereby said movable contact wipes across said stationary contact.

9. A circuit breaker as set forth in claim 8 in which during the limited movement of said contact arm said movable contact moves toward said support.

10. A circuit breaker as set forth in claim 2 in which the contact arm includes first and second members in side-by-side relationship and abutting one another at said one end; said first member including said first section and said first portion; said second member including said second section and said second portion; said movable contact being secured to both said members and extending across the interface therebetween.

11. A circuit breaker as set forth in claim 10 in which the biasing means is disposed remote from said other end.

12. A circuit breaker as set forth in claim 10 in which the biasing means is disposed at a midregion lengthwise of said sections.

13. A circuit breaker as set forth in claim 1 in which currents flowing in the same direction in said members generate an electrodynamic force therebetween that produces a supplementary force at said support which acts to aid said biasing means in clamping said support between said portions; under severe fault current conditions said supplementary force being substantially counteracted by electrodynamic blowoff forces generated at said support by currents flowing at the interfaces between said support and said portions.

14. A circuit breaker including a stationary contact, a movable contact operable into and out of engagement with said movable contact, an elongated contact arm having said stationary contact at one end thereof, a pivot to which the other end of said contact arm is mounted for pivotal movement of said contact arm between circuit breaker on and off positions, a conducting support for said pivot, said contact arm at said other end being bifurcated into first and second portions between which said support is disposed, and biasing means clamping said support between said portions to form good electrical wiping contact between said support and said contact arm while the latter is stationary as well as while it moves between said on and off positions, said pivot extending through enlarged aligned openings in said first and second portions; a terminal strap on which the support is mounted; each of said portions including an ear that engages said terminal strap during movement of said contact arm to said off position to cooperate therewith and provide another center about which said contact arm pivots after initial pivotal movement thereof about said pivot as a center.

15. A circuit breaker as set forth in claim 14 in which each of the aligned openings is partly defined by a cam surface; during movement of said contact arm from said off position to initial engagement between said contacts said pivot being disposed at a first location along said cam surface, and further movement of said contact arm toward said arm position after initial engagement between said contacts causing each of said cam surfaces to move relative to said pivot to cooperate therewith and impart limited longitudinal movement to said contact arm whereby said movable contact wipes across said stationary contact.

16. A circuit breaker as set forth in claim 15 in which the limited longitudinal movement of said contact arm is toward said terminal strap.

17. A circuit breaker comprising:

a stationary contact;

a movable contact operable into and out of engagement with said stationary contact;

an elongated contact arm having said stationary contact at one end thereof;

a pivot to which the other end of said contact arm is mounted for pivotal movement of said contact arm between circuit breaker on and off positions;

a conducting support for said pivot, said contact arm at said other end being bifurcated into first and second portions between which said support is disposed; and, biasing means clamping said support between said portions to form good electrical wiping contact between said support and said contact arm while the latter is stationary as well as while it moves between said on and off positions, said pivot extending through enlarged openings in said first and second portions and each of said openings being partly defined by a cam surface, during movement of said contact arm from said off position to initial engagement between said contacts said pivot being disposed at a first location along said cam surface, and further movement of said contact arm toward said arm position after initial engagement between said contacts causing each of said cam surfaces to move relative to said pivot to cooperate therewith and impart limited longitudinal movement to said contact arm whereby said movable contact wipes across said stationary contact.

18. A circuit breaker as set forth in claim 17 in which during the limited movement of said contact arm said movable contact moves toward said support.

* * * * *